US010993522B2

(12) United States Patent
Naftal

(10) Patent No.: US 10,993,522 B2
(45) Date of Patent: May 4, 2021

(54) STRIP BRUSH ASSEMBLY HAVING METAL AND POLYMER BRISTLES AND METHOD OF MAKING

(71) Applicant: Keystone Plastics Inc., South Plainfield, NJ (US)

(72) Inventor: Brian Naftal, South Plainfield, NJ (US)

(73) Assignee: Keystone Plastics Inc., Plainfield, NJ (US)

( * ) Notice: Subject to any disclaimer, the term of this patent is extended or adjusted under 35 U.S.C. 154(b) by 162 days.

(21) Appl. No.: 15/689,954

(22) Filed: Aug. 29, 2017

(65) Prior Publication Data

US 2018/0055204 A1 Mar. 1, 2018

Related U.S. Application Data

(60) Provisional application No. 62/381,502, filed on Aug. 30, 2016.

(51) Int. Cl.

| | |
|---|---|
| ***A46B 3/04*** | (2006.01) |
| ***A46B 9/06*** | (2006.01) |
| ***E01H 1/05*** | (2006.01) |
| ***A46D 3/00*** | (2006.01) |
| ***A46D 9/02*** | (2006.01) |

(52) U.S. Cl.

CPC ..... *A46B 3/04* (2013.01); *A46B 9/06* (2013.01); *A46D 3/005* (2013.01); *A46D 9/02* (2013.01); *E01H 1/056* (2013.01); *A46B 2200/3066* (2013.01)

(58) Field of Classification Search

CPC . A46D 3/00; A46D 3/005; A46D 9/02; A46D 1/06; A46B 3/04; A46B 9/06; E01H 1/056

USPC ..... 15/179, 182, 183; 300/2, 21, 17

See application file for complete search history.

(56) References Cited

U.S. PATENT DOCUMENTS

| | | | | |
|---|---|---|---|---|
| 3,186,019 A * | 6/1965 | Hattori | A46B 9/06 15/179 |
| 5,819,357 A | 10/1998 | Gould | |
| 6,665,902 B1 * | 12/2003 | Vegter | A46B 3/20 15/183 |
| 7,203,987 B2 * | 4/2007 | Kuivikko | A46B 7/04 15/180 |

(Continued)

FOREIGN PATENT DOCUMENTS

| | | | |
|---|---|---|---|
| DE | 102009043167 A1 * | 5/2011 | A46B 13/005 |

OTHER PUBLICATIONS

Translation of DE102009043167, pulled from Espacenet on Dec. 31, 2019 (Year: 2009).*

*Primary Examiner* — Laura C Guidotti
*Assistant Examiner* — Thomas Raymond Rodgers
(74) *Attorney, Agent, or Firm* — Gloria Tsui-Yip, Esq.; Gottlieb, Rackman & Reisman, P.C.

(57) ABSTRACT

A strip brush assembly with a plurality of elongated polymer bristles forming a section and a plurality of elongated metal bristles forming another section adjacent the polymer bristles section, such that the metal bristles section is supported by the polymer bristles section. The polymer and metal bristles are bonded and encapsulated in a base formed by direct extrusion onto and around the polymer and metal bristles to secure them to the formed base. The strip brush assembly may be used on a tubular mandrel of a street sweeper.

5 Claims, 8 Drawing Sheets

(56) References Cited

U.S. PATENT DOCUMENTS

| | | | | |
|---|---|---|---|---|
| 7,677,675 | B2 * | 3/2010 | Vegter | A46D 3/005 300/2 |
| 2005/0081316 | A1 * | 4/2005 | Dondi | A46B 13/003 15/179 |
| 2018/0021644 | A1 * | 1/2018 | White | A46B 15/0055 15/106 |

* cited by examiner

STRIP BRUSH ASSEMBLY HAVING METAL AND POLYMER BRISTLES AND METHOD OF MAKING

This application claims benefit of provisional patent application Ser. No. 62/381,502 filed on Aug. 30, 2016, which is hereby incorporated by reference.

FIELD OF THE INVENTION

The invention relates to a strip brush assembly typically for use with a cylindrical mandrel and the method of making. In particular, the improved strip brush assembly has both metal and polymer bristles.

BACKGROUND OF THE INVENTION

Street sweepers are vehicles that have a plurality of brush assemblies mounted thereon to clean streets. Typically a street sweeper has a cylindrical mandrel driven to rotate around its central axis mounted on the underside of the vehicle. Such central axis is generally perpendicular to the direction of movement of the street sweeper. Radially extending from the mandrel are a plurality of elongated bristles that, when the mandrel is rotated, result in a sweeping motion. A street sweeper may also have a pair of gutter brooms each having a disk shaped plate with tufts of metal wires extending from the planar surface towards the ground. The disk is mounted on each side of the street sweeper and is rotated to clean the street.

Due to the strong force that the bristles endure with repeated contact with the street, the bristles need to be replaced often. To facilitate the replacement of bristles, on the surface of existing mandrel are a plurality of channels that extend axially (helically, straight, curved, etc.). Each channel receives a strip brush assembly that includes a base that correspondingly and slidably mates with the channel. Extending from the base are a plurality of bristles.

Existing strip brush assembly is typically made entirely of polypropylene, including the base and the bristles. While there are benefits to have a strip brush assembly completely made of polypropylene, such as allowing the recycling of the entire strip brush assembly when it is worn, it lacks the aggressive cleaning of metal bristles. However, the use of only metal bristles in a strip brush assembly would not work for a street sweeper. As mentioned above, when the bristles are in contact with the street, there is a strong force against the bristles. As polypropylene bristles are resilient, they bend as they come into contact with the street and would return to its original at rest position after contacting the street, providing an efficient sweeping motion with the flicking/whisking action of the polypropylene bristles. On the other hand, metal bristles would bend, and stay bent, rendering it useless to provide a sweeping motion.

There are a number of prior art methods of making a strip brush assembly using either polypropylene bristles only or metal bristles only. See, e.g., U.S. Pat. No. 5,819,357 to Frances Gould and U.S. Pat. No. 6,665,902 to Hinderikus Vegter. The prior art methods disclosed in the '357 and '902 patents cannot be easily adapted to make a strip brush assembly having both polymer and metal bristles. Any attempt to adapt the prior art methods would be costly, in both the need of manpower and required stocking of raw material, and requires additional steps. There is no known method of efficiently and effectively making a strip brush assembly having both metal and polymer bristles or strip brush assembly having both metal and polymer bristles that is structurally sound and can withstand the force associated with a street sweeper.

Therefore, there is a need for an improved method of efficiently and effectively making a strip brush assembly having both metal and polymer bristles and an improved resultant strip brush assembly.

SUMMARY OF THE INVENTION

The present invention is an improved strip brush assembly having both metal and polymer bristles. A plurality of metal bristles are supported by a plurality of polymer bristles and mounted to a base having a corresponding shape for fitting into a corresponding channel on the surface of a mandrel.

The metal bristles and polymer bristles of the strip brush assembly extend vertically from an extrusion formed base and may be interspersed among each other or form distinctive sections (such as upper layer section and lower layer section) so long as the metal bristles are supported by some polymer bristles. The metal bristles of the strip brush assembly are generally straight and elongated and may be a straight wire or a crimped wire. Each metal bristle may be crimped either in two-dimension or in three-dimension direction. The polymer bristles of the strip brush assembly are generally straight and elongated and have a generally uniform cross-sectional shape such as generally circular or oval. The polymer bristles may have a wavy profile either in two-dimension or in three-dimension direction.

The method of the present invention includes the following steps:

1. providing a plurality of polymer bristles having first ends, aligned on a horizontal surface with the first ends of the polymer bristles in a first generally linear alignment;
2. providing a plurality of wire bristles having first ends, placed on the horizontal surface on top of the polymer bristles, with the first ends of the metal bristles in the first generally linear alignment;
3. extruding a formed base directly onto and around the first ends of the polymer and metal bristles;
4. cooling the extrusion formed base; and
5. cutting the extrusion formed base to form a strip brush assembly of a desired length.

Step 1 and Step 2 may be interchanged such that the wire bristles are first placed on the horizontal surface, with the polymer bristles placed on top of the wire bristles. Alternatively, the polymer bristles may be placed interspersed among the metal bristles. For certain other applications, Step 1 can be deleted to produce an all metal bristles strip brush assembly.

The method of the present invention is easily performed on a conveyor belt with the extruder and cooler positioned adjacent and along the first generally linear alignment.

BRIEF DESCRIPTION OF THE DRAWINGS

Preferred embodiments of the present invention have been chosen for purposes of illustration and description and are shown in the accompanying drawings, which are not necessarily to scale, forming a part of the specification wherein:

FIG. 2 is a profile view of an example of a shaped base that polymer and metal bristles extend from.

DETAILED DESCRIPTION OF THE INVENTION

Figure 1:
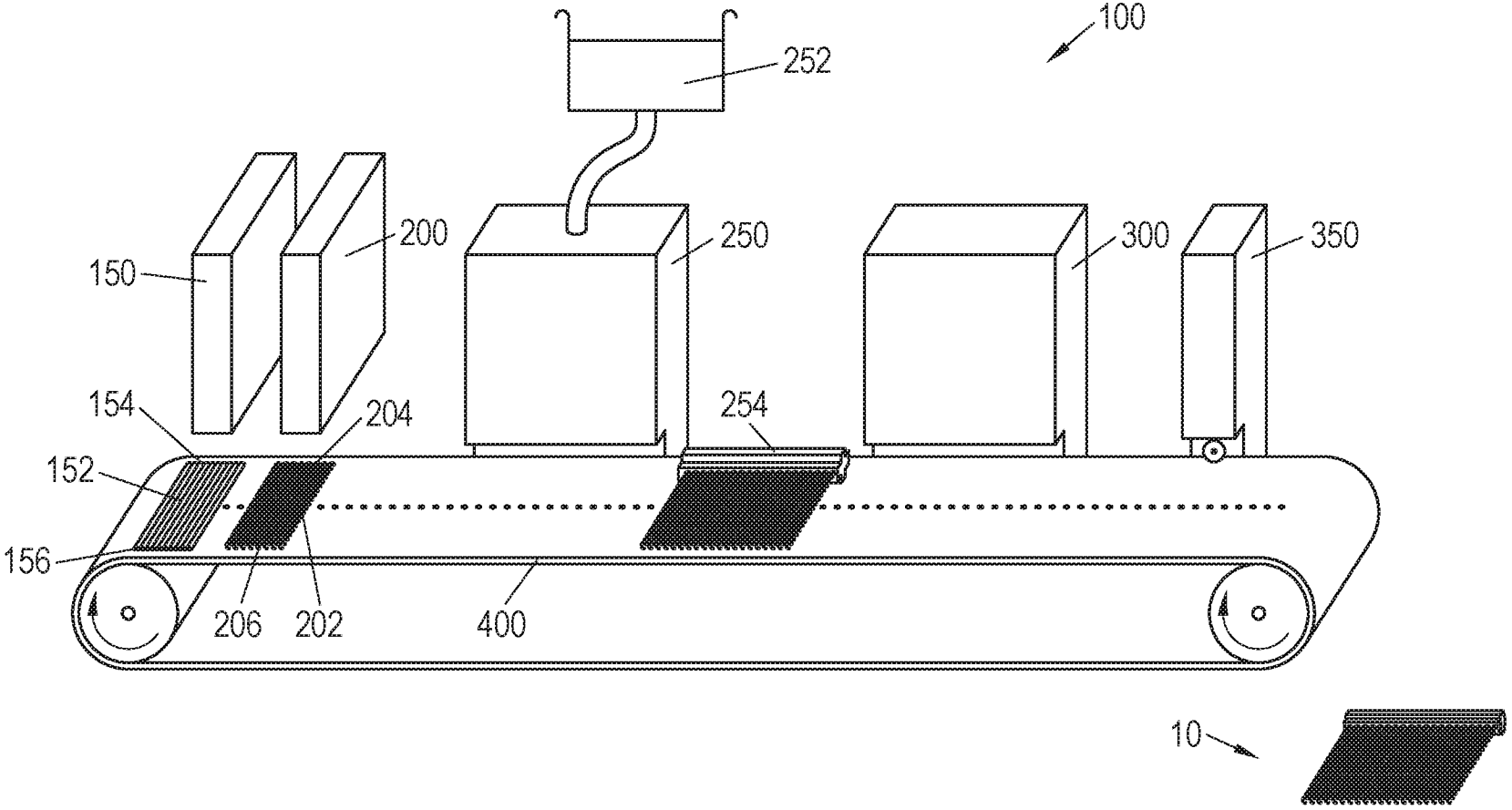
FIG. 1 is a simplified representation of the process of making the strip brush assembly of the present invention having both metal and polymer bristles.

With reference to the drawings, wherein the same reference number indicates the same element throughout, there is shown in FIG. 1 a simplified representation of the process of the present invention. The system 100 for the process of the present invention includes a polymer bristles dispenser 150, a metal bristles dispenser 200, an extruder 250, a cooling device 300, a cutter 350, and a conveyor belt 400 that moves the components from the beginning to a finished product.

The polymer bristles dispenser 150 dispenses a plurality of predetermined length elongated polymer bristles 152 onto the conveyor belt 400. The plurality of polymer bristles 152 are dispensed to lay generally flat on the surface of the conveyor belt 400, abutting or closely adjacent each other. A positioning device (not shown) may be provided to ensure the first ends 154 of the polymer bristles 152 are in a general linear alignment with the direction of the movement of the conveyor belt 400. When the polymer bristles 152 are dispensed, one or multiple layers of polymer bristles 152 may lay on the surface of the conveyor belt 400, depending on the desired application of the finished strip brush assembly 10.

The raw material for the polymer bristles 152 typically comes in a continuous coil of elongated polymer strips. The polymer strip is unwound, then machine cut to an appropriate length to form the predetermined length polymer bristles 152. The raw material for the polymer bristles 152 may be automated from unwinding the polymer strips to machine cutting the polymer strips, and then feeding into the polymer bristles dispenser 150 or be incorporated as a unit with the polymer bristles dispenser 150. The polymer bristles 152 may be made of polypropylene, nylon, other thermoplastic material, or other polymer. The polymer bristle 152 has a generally uniform cross-sectional shape, such as generally circular, generally oval, or generally ellipse. Optionally, the polymer bristles may have a slightly wavy profile having a generally uniform amplitude. For a polymer bristle 152 with an ellipse cross-sectional shape, the major diameter can be in the range of 0.06 to 0.16 inch and the minor diameter can be in the range of 0.05 to 0.11 inch. The polymer bristles 152 may be cut to a predetermined length of between 7 to 15 inches. For a strip brush assembly 10 for use with a street sweeper, the polymer bristles 152 may have a minor diameter of 0.085 inch, a major diameter of 0.135 inch and length of 13 inches.

The metal bristles dispenser 200 dispenses a plurality of predetermined length elongated metal bristles 202 onto the conveyor belt 400. The plurality of metal bristles 202 are dispensed to lay generally flat on top of the plurality of polymer bristles 152, abutting or closely adjacent each other. A positioning device (not shown) may be provided to ensure the first ends 204 of the metal bristles 202 are in a general linear alignment with the first ends 154 of the polymer bristles 152, which are in a general linear alignment with the direction of the movement of the conveyor belt 400. When the metal bristles 202 are dispensed, one or multiple layers of metal bristles 202 may lay on top of the plurality of polymer bristles 152, depending on the desired application of the finished strip brush assembly 10.

The raw material for the metal bristles 202 typically comes in a continuous coil of elongated metal wire. The metal wire is unwound, crimped, then machine cut to form the predetermined length metal bristles 202. The crimping of the metal wire is performed by a crimping machine having two driven rotating, and opposing, dies. The crimped metal bristle 202 is generally straight and has a generally sinusoidal curve (in 2-dimensional or 3-dimensional direction) with a generally uniform amplitude, without any sharp corners or deformed area where breakage can occur. While use of a crimping machine with one die to form the crimped metal bristle 202 is possible, it would produce a crimped metal bristle 202 that is not as straight (and may have an overall arc) and in a non-uniform/uneven zig-zag configuration with possibly sharp corners or deformed area. The raw material for the metal bristles 202 may be automated from unwinding the metal wire, crimping the metal wire and machine cutting the metal wire, and then feeding into the metal bristles dispenser 200 or be incorporated as a unit with the metal bristles dispenser 200. The metal bristle 202 has a generally uniform cross-section shape, such as generally round, generally oval, or generally ellipse. The diameter of the metal bristle 202 can be in the range of 0.015 to 0.050 inch. The metal bristle 202 may have a tensile strength of 200,000 to 400,000 psi, and a crimped amplitude of 0.09 to 0.1 inch. Similar to the polymer bristles 152, the metal bristles 202 may be cut to a predetermined length of between 7 to 15 inches. For a strip brush assembly 10 for use with a street sweeper, the metal bristles 202 may have a round cross-sectional shape with a diameter of 0.028 inch and a tensile strength of 260,000 to 290,000 psi.

The extruder 250 takes raw material 252 and heats it to a molten state and extrudes it through a die to form a predetermined shaped base 254 onto and over the first ends 154 and 202 of the polymer and metal bristles 152 and 202 being carried on the conveyor belt 400. The first ends 154 of the polymer bristles 152 may be pre-heated/warmed before the extruder 250 to improve bonding of the extruded base 254 with the polymer bristles 152. When the extruder 250 extrudes the molten raw material 252 over the first ends 154 and 204 of the polymer and metal bristles 152 and 202, it flows in between and permeates the first ends 154 and 204 to bond and encapsulate the first ends 154 and 204 in a formed base 254 and provides a secure anchor of the polymer and metal bristles 152 and 202 in the formed base 254 in one step.

Figure 2:
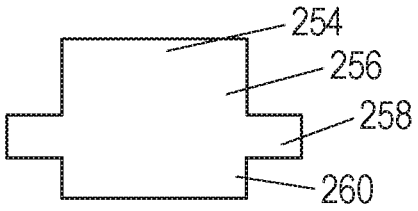
Figure 3:
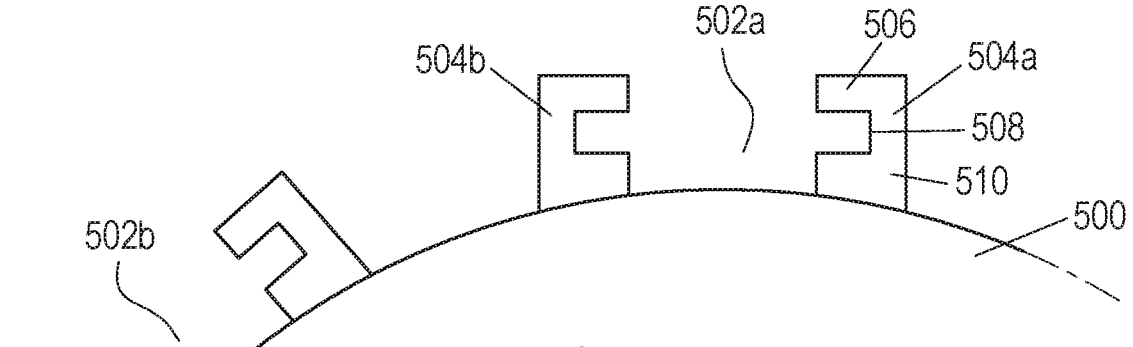
FIG. 3 is a profile view of two adjacent channels on a mandrel that receive the base shown in FIG. 2.
Figure 4:
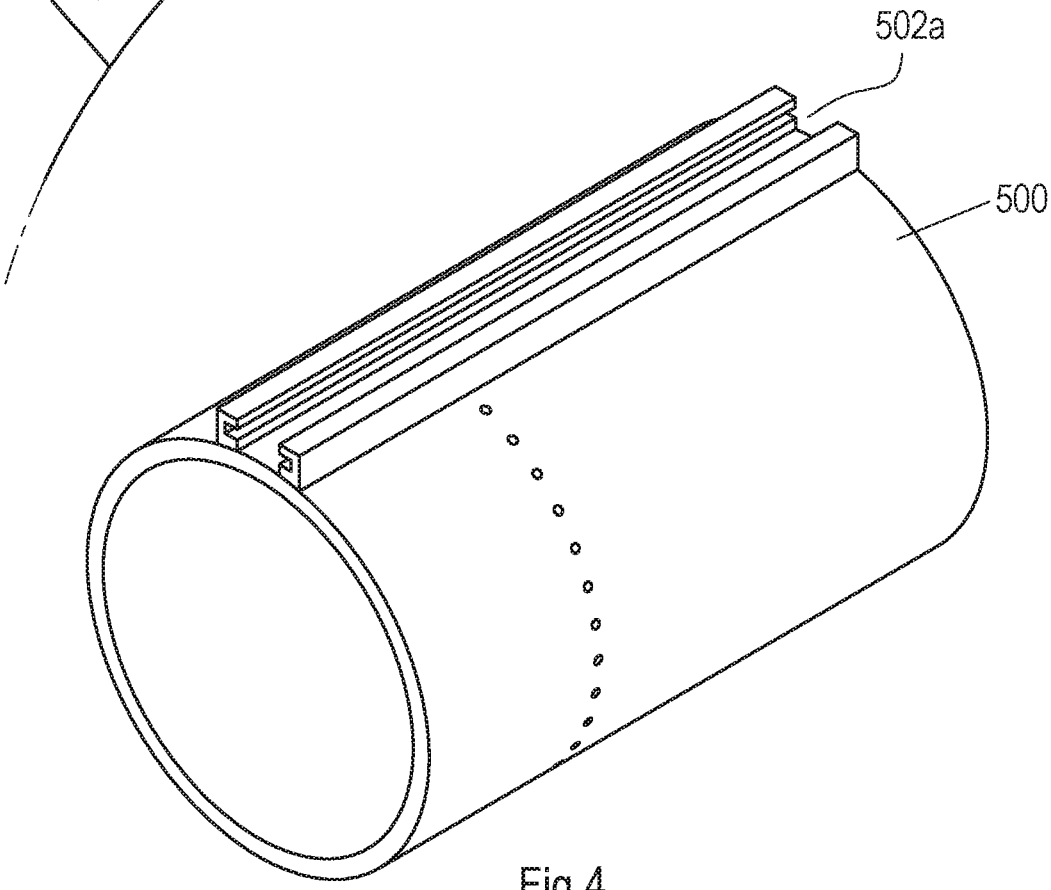
FIG. 4 is a simplified perspective view of the channel of FIG. 3 on a mandrel.

The die of the extruder 250 may have a predetermined cross-sectional profile shape as shown in FIG. 2 to form the predetermined shaped base 254, which has a narrower upper section 256, a wider mid section 258, and a narrower lower section 260. FIGS. 3 and 4 illustrate channels 502*a* and 502*b* on the surface of a prior art mandrel 500 that can receive base 254. A strip brush assembly 10 with base 254 is slidably fit into each channel 502*a* and 502*b*. Each channel 502*a* and 502*b* has a corresponding shape that can receive the base 254 and is formed from a pair of opposing facing C-shaped corresponding rails 504*a* and 504*b*. The upper portion 506 of the rails 504*a* and 504*b* mate with the upper section 256 of base 254. The mid portion 508 of the rails 504*a* and 504*b* mate with the mid section 258 of base 254. The lower portion 510 of the rails 504*a* and 504*b* mate with the lower section 260 of base 254. The base 254 should fit tightly (with little tolerance) in the channels 502*a* and 502*b* to minimize rocking of the strip brush assembly 10 when being used. Base 254 having different cross-sectional shapes can easily be formed and extruded by simply changing the die of the extruder 250 to a different shape (such as upside down T shape, U shape, A shape, or any other customizable shape, and not necessarily shaped to fit into a channel).

The cooling device 300 cools the formed base 254 with the polymer and metal bristles 152 and 202 extending therefrom that are moved on the conveyor belt 400 after being extruded from the extruder 250. The cooling device 300 aids in retaining the shape of the formed base 254 as it exits from the die of the extruder 250.

The cutter 350 cuts the formed base 254 as it moves on the conveyor belt 400 to form strip brush assembly 10 of a desired length. Optionally, either before or after the cutter 350, the second ends 156 and 206 of the polymer and metal bristles 152 and 202 may further be trimmed to ensure all have the same length. Optionally, either before or after the cutter 350, the base 254 may also be trimmed or grinded to provide a more polished base 254 to improve tolerance such that the strip brush assembly 10 can easily be inserted into and retained within corresponding channels 502*a* or 502*b* of mandrel 500 according to specification.

The steps in carrying out the process of the present invention to manufacture a strip brush assembly 10 of the present invention with the polymer bristles dispenser 150, metal bristles dispenser 200, extruder 250, cooling device 300, cutter 350, and conveyor belt 400 as shown in FIG. 1 are as follow:

1. Dispensing with the polymer bristles dispenser 150 a plurality of polymer bristles 152 of a predetermined length in at least one layer abutting and in general alignment with each other onto the surface of a conveyor belt 400.

2. Dispensing with the metal bristles dispenser 200 a plurality of metal bristles 202 of the predetermined length in at least one layer abutting and in general alignment with each other on top of and in general alignment with the layer of polymer bristles 152 on the surface of the conveyor belt 400.

3. Extruding with the extruder 250, having a predetermined shaped die, a formed base 254 onto the first ends 154 and 204 of the polymer and metal bristles 152 and 202 as they move on the conveyor belt 400 to bond and encapsulate the first ends 154 and 204 within the formed base 254.

4. Cooling with the cooling device 300 the formed base 254 as it moves on the conveyor belt 400.

5. Cutting with the cutter 350 the formed base 254 as it moves on the conveyor belt 400 at a predetermined length to form a strip brush assembly 10 of a desired length.

Figure 5:
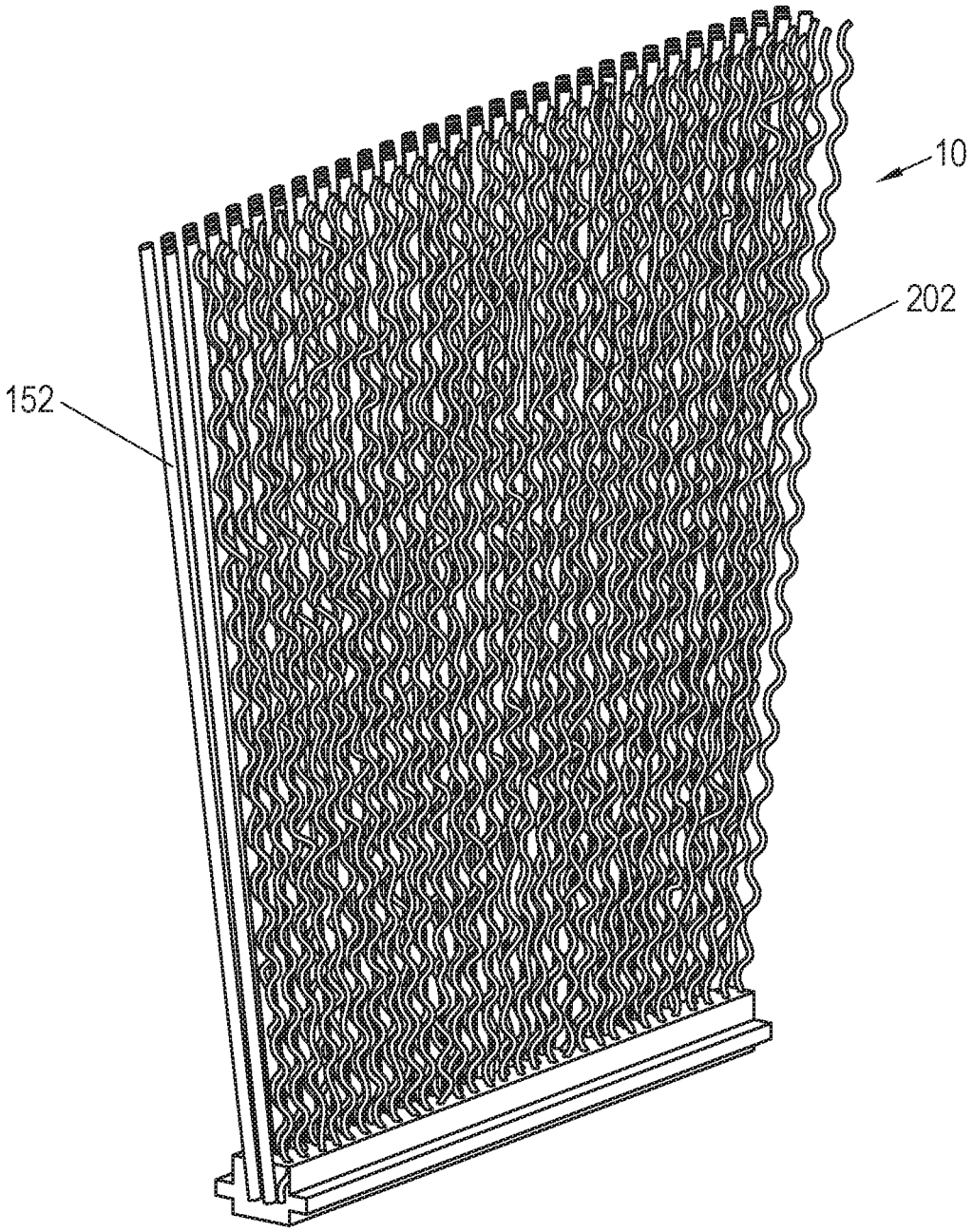
FIG. 5 is a perspective view of the strip brush assembly of the present invention having both metal and polymer bristles.
Figure 6:
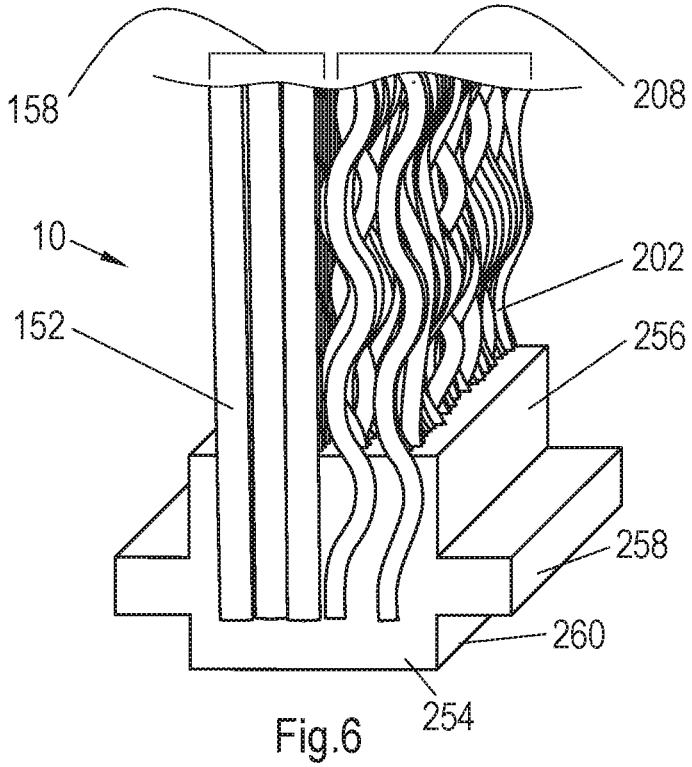
FIG. 6 is a zoomed in perspective view of the base of FIG. 5.
Figure 7:
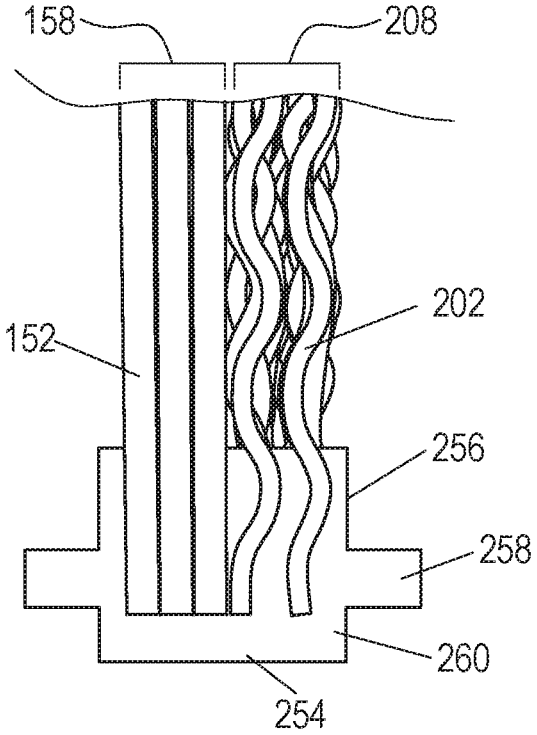
FIG. 7 is a zoomed in side view of the base of FIG. 6

The order of Steps 1 and 2 can be reversed such that the layer(s) of a plurality of metal bristles 202 is first dispensed onto the surface of the conveyor belt 400 with the layer(s) of a plurality of polymer bristles 152 dispensed on top of the layer(s) of metal bristles 202 in a stacked manner as shown in FIG. 5. Further, for Steps 1 and 2, the polymer and metal bristles 152 and 202 may be dispensed such that the polymer and metal bristles 152 and 202 are interspersed among each other.

The specification above and the drawings show a layer of polymer bristles 152 forming a section and a layer of metal bristles 202 forming another section above it, additional alternating of sections with layers of either polymer bristles 152 or metal bristles 202 may be dispensed to form a strip brush assembly 10 with more than two layers of bristles. For example, a strip brush assembly 10 may have two sections of polymer bristles 152 sandwiching a section of metal bristles 202 therebetween, or vice versa. Further, an additional section of other type of bristle layer or material layer (such as felt, micro fiber, baffle strip, etc.) can also be added to the two sections of bristle layers.

While FIG. 1 only shows distinctive sections of polymer and metal bristles 152 and 202 or strip brush assembly 10 on the conveyor belt 400, it is understood that the polymer and metal bristles 152 and 202 are continuous as reflected and represented by the dots on the conveyor belt 400. Further, while a horizontal conveyor belt 400 system is disclosed, other types of assembly lines, such as having the polymer and metal bristles 152 & 202 in a vertical position (instead of a horizontal position) can be used to achieve the steps and process of the present invention. Due to the use of raw materials and the continuous nature of the process, advantageously, there is minimum interruption to the assembly line from having to reload or supply material for the process.

Optionally, between Steps 2 and 3, an additional step of pre-heating or warming the first ends 154 and 204 of the polymer and metal bristles 152 and 202 would improve bonding with the extruded formed base 254. Optionally, between Steps 4 and 5 or after Step 5, an additional step of trimming the second ends 156 and 206 of the polymer and metal bristles 152 and 202 would ensure all bristles 152 and 202 have the same length. Optionally, between Steps 4 and 5 or after Step 5, an additional step of trimming or grinding the formed base 254 would provide a more polished base 254 to improve tolerance such that the strip brush assembly 10 can easily be inserted into and retained within corresponding channels 502*a* or 502*b* of mandrel 500.

FIGS. 5-9 show a strip brush assembly 10 made from the process of the present invention. Each strip brush assembly 10 has a predetermined length with a plurality of polymer and metal bristles 152 and 202. The side views of the strip brush assembly 10 show that there are about three polymer bristles 152 thick forming the polymer bristles section 158 and about two metal bristles 202 thick forming the metal bristles section 208. Different thickness of polymer and metal bristles sections 158 & 208 can be easily customized and adjusted for the intended final use of the strip brush assembly 10 by adjusting the speed of the polymer and metal bristles dispensers 150 and 200 and/or speed of the conveyor belt 400. The first ends 154 and 204 of the polymer and metal bristles 152 and 202 are fully bonded, encapsulated and securely anchored in the extruded formed base 254. The total thickness of polymer and metal bristles sections 158 & 208 must be smaller than the upper and lower sections 256 and 260 of the formed base 254 extruded through the die in the extruder 250 to ensure secure anchoring of the polymer and metal bristles 152 and 202.

Although FIGS. 5-9 show a strip brush assembly 10 having two distinct sections, a polymer bristles section 158 and a metal bristles section 208, the polymer and metal bristles 152 and 202 may be interspersed and distributed among each other. Similarly, multiple polymer bristles section 158 and/or metal bristles section 208 can be used to form a strip brush assembly. Further, additional distinct section(s) other than the polymer bristles section 158 and the metal bristles section 208, such as a section of felt, microfiber, baffle strip, can be added.

Figure 8:
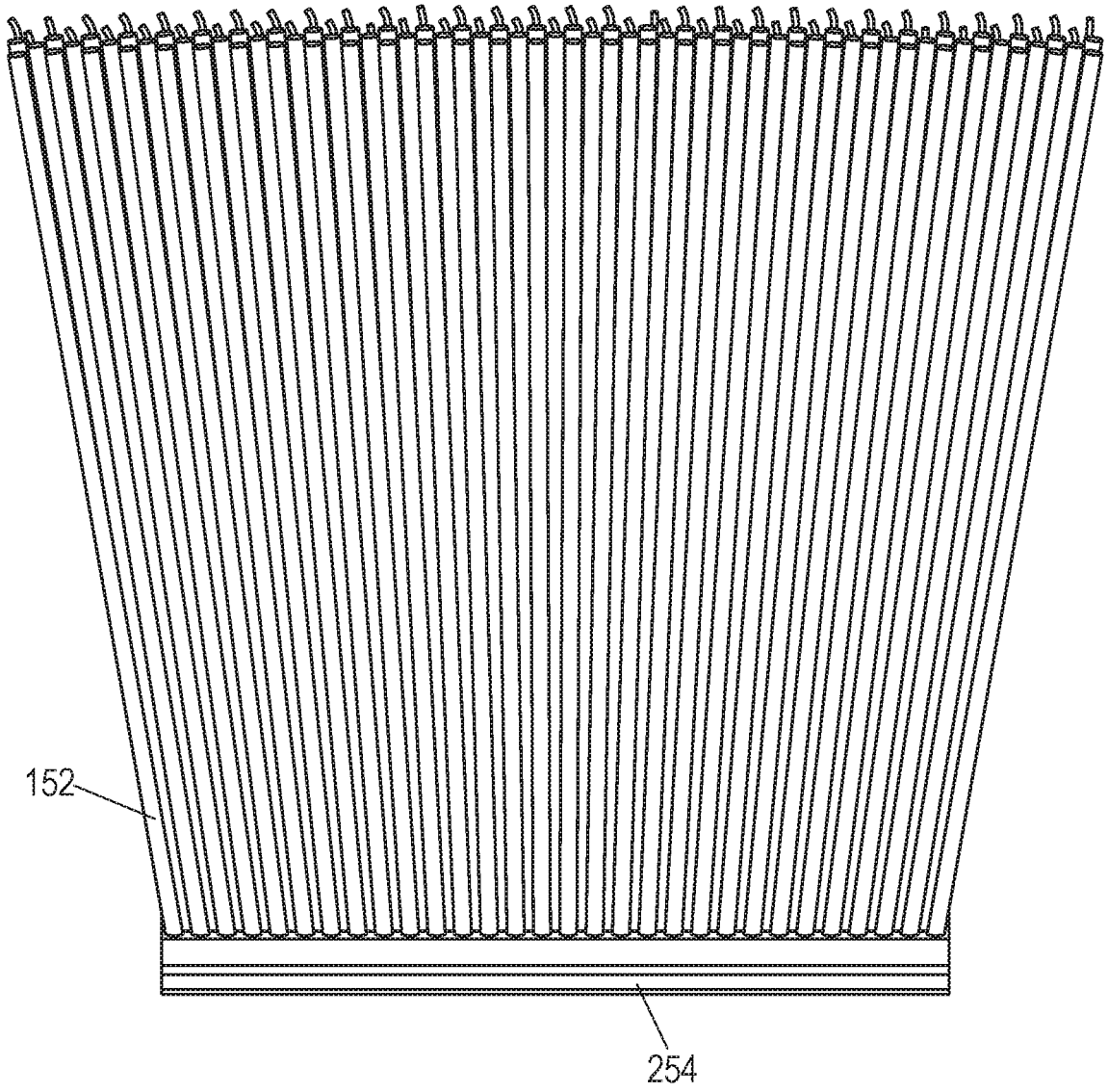
FIG. 8 is a rear view of the strip brush assembly of the present invention having both metal and polymer bristles.
Figure 9:
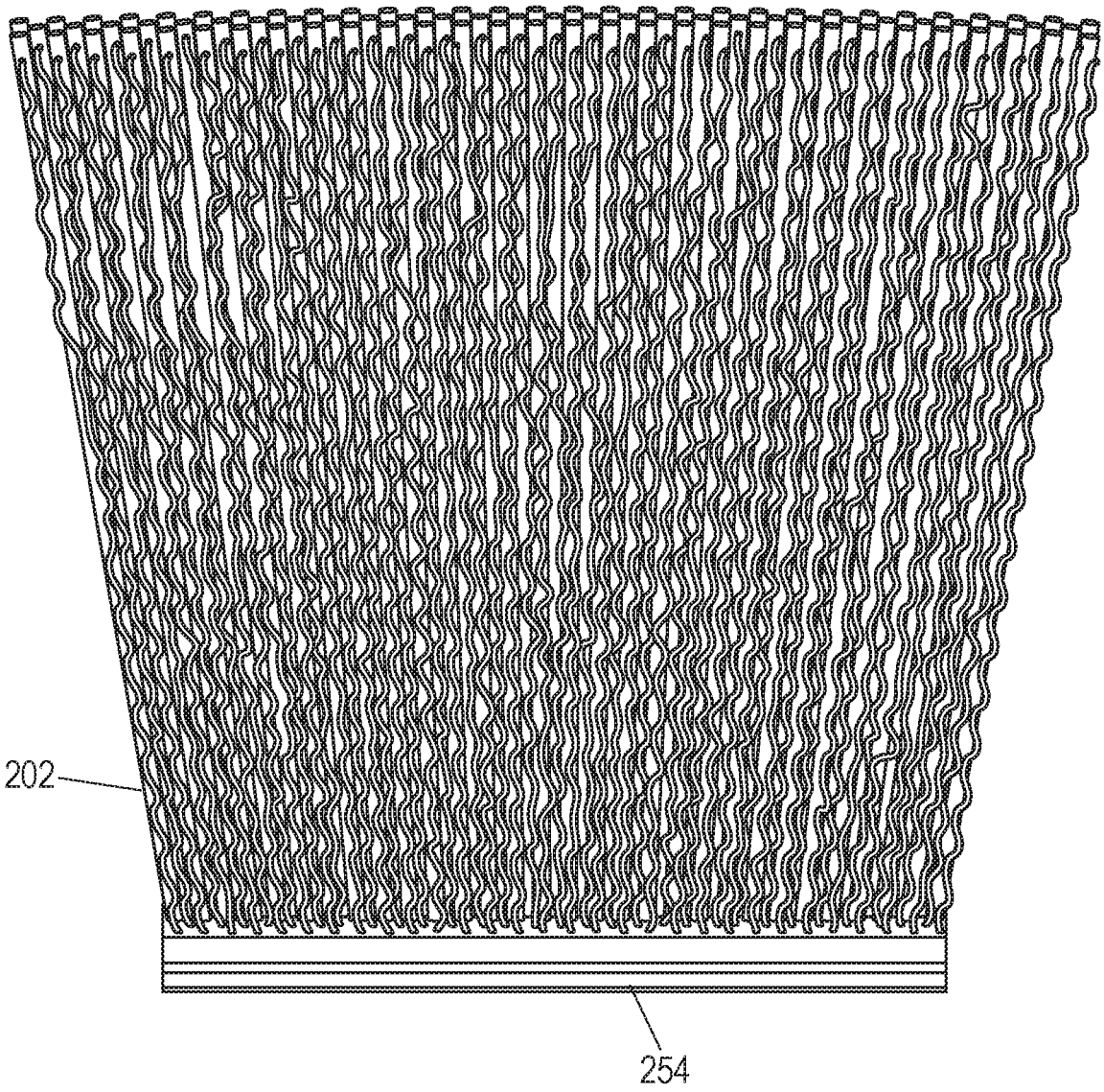
FIG. 9 is a front view of the strip brush assembly of the present invention having both metal and polymer bristles.
Figure 10:
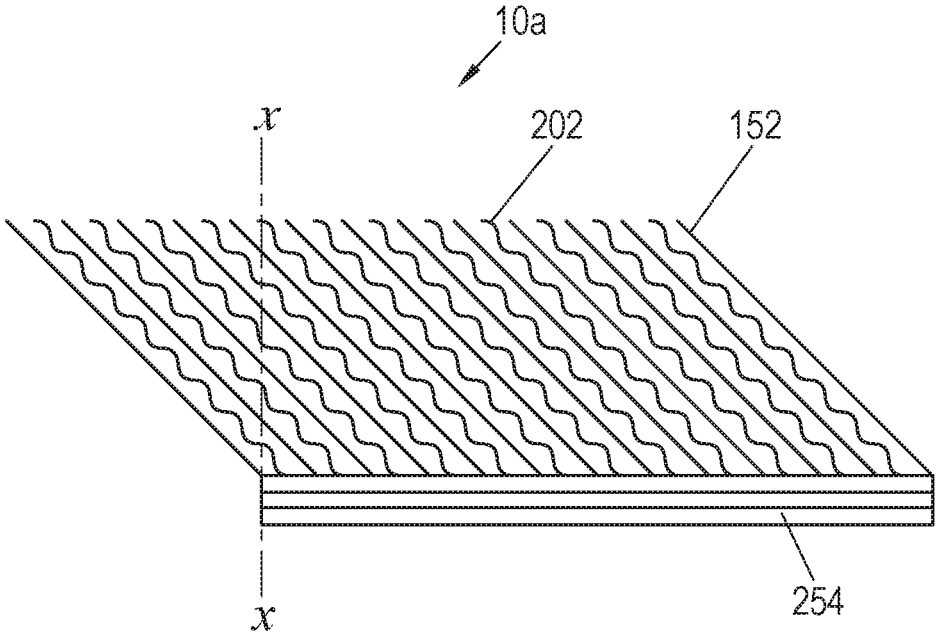
FIG. 10 is a front, simplified, view of an alternate strip brush assembly of the present invention.
Figure 11:
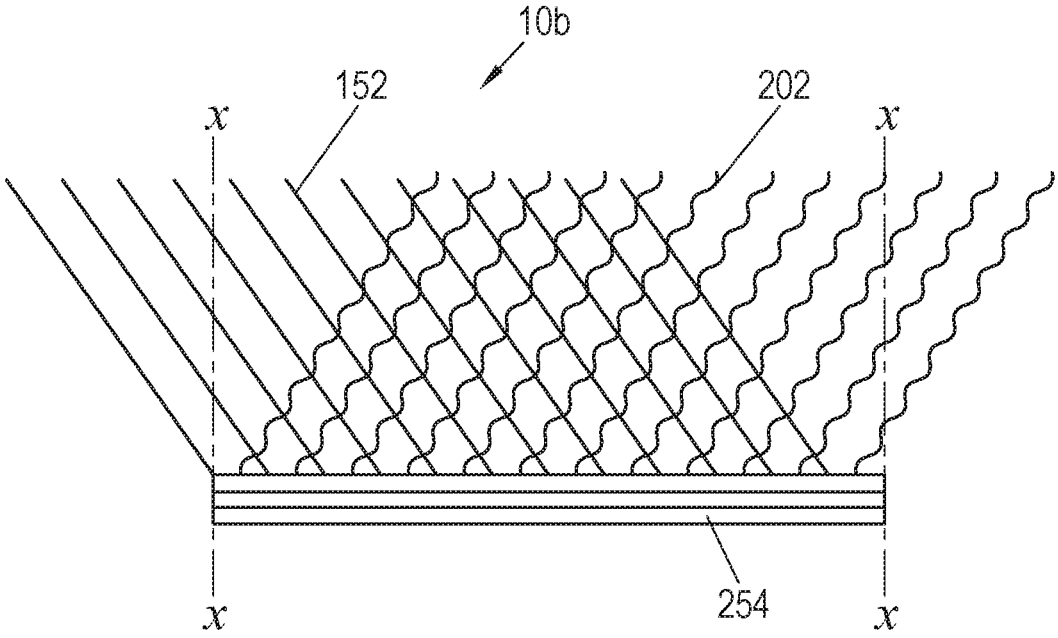
FIG. 11 is a front, simplified, view of another alternate strip brush assembly of the present invention.

Although the polymer and metal bristles 152 & 202 of strip brush assembly 10 are shown to be extending substantially perpendicular from the base 254 in FIGS. 8 and 9, the polymer and metal bristles 152 & 202 may extend from the base 254 at an angle. FIG. 10 shows a strip brush assembly 10*a* with both the polymer and metal bristles 152 & 202 extending from the base 254 at substantially the same angle at the same direction. However, the polymer and metal bristles 152 and 202 in FIG. 10 may extend from the base 254 at different angles. FIG. 11 shows a strip & assembly 10*b* with the polymer and metal bristles 152 & 202 extending from the base 254 at substantially the same angle at opposite directions. Similarly, the angles can be different for the polymer and metal bristles 152 & 202 in FIG. 11. If desired, the polymer and metal bristles 152 & 202 that extend beyond the length of the base 254 may be trimmed along dotted lines X. The process of making the strip brush assembly 10*a* and 10*b* is similar to that of making strip brush assembly 10, with the only difference being how the polymer and metal bristles 152 & 202 are dispensed from the polymer and metal bristles dispenser 150 & 200 (i.e. dispensed at an angle).

Figure 12:
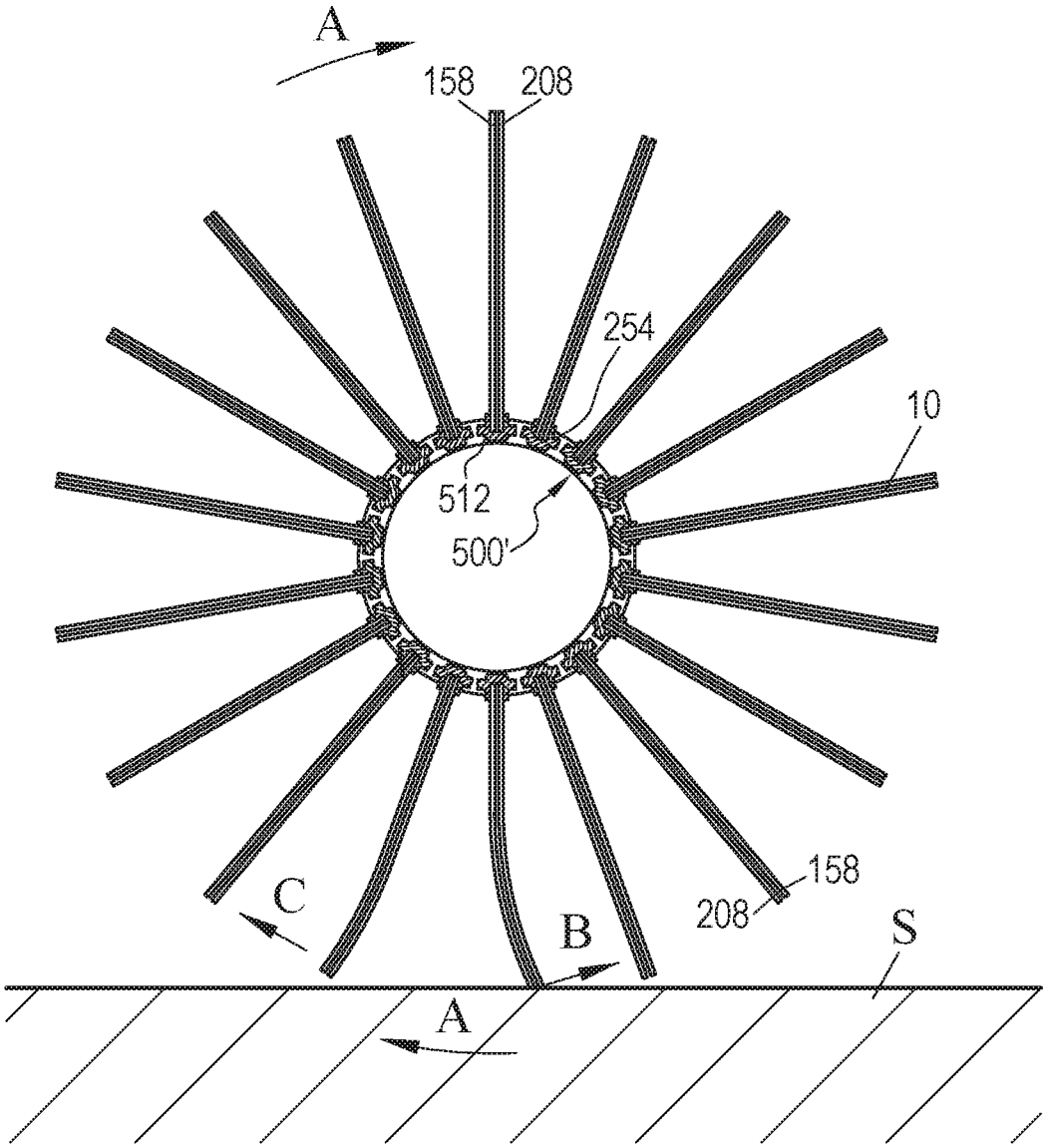
FIG. 12 is a side view of another mandrel with a plurality of strip brush assembly of the present invention.

FIG. 12 illustrates multiple strip brush assemblies 10 inserted into channels 512 on a mandrel 500' for street sweeping. The polymer and metal bristles 152 and 202 are shown in simplified form and represented by their respective polymer and metal bristles sections 158 and 208. Each strip brush assembly 10 is radially extending from the mandrel 500' and substantially perpendicular to the surface of the mandrel 500'. Each strip brush assembly 10 has the metal bristles section 208 as the leading section in the direction of rotation, A. As the mandrel 500' is rotated in the direction A, the metal bristles section 208 first comes into contact with the street surface S, which causes the more malleable metal bristles section 208 to be pushed against and away from the street surface S and moves in direction B. However, the metal bristles section 208 is supported behind by the more resilient polymer bristles section 158 and the metal bristles section 208 will not get bent out of shape. As the mandrel 500' continues its rotation in the direction A, the strip brush assembly 10 lifts away from the street surface S, and due to the resiliency of the polymer bristles section 158, the polymer bristles section 158 would flick or whisk forward in direction C before returning to its at rest position (substantially perpendicular to the surface of the mandrel 500') to provide an efficient sweeping motion. With the plurality of strip brush assemblies 10 sufficiently close to each other on the mandrel 500' such that at least two adjacent strip brush assemblies 10 are in contact with the street surface S at a time provides a continuous sweeping and engagement of the street surface S.

In summary, the strip brush assembly 10 of the present invention utilizes a section of polymer bristles section 158 to support a section of metal bristles section 208 to prevent the metal bristles from bending out of shape. The presence of metal bristles 206 advantageously provides a better, more thorough, and deeper, cleaning and digging of the street surface, and lasts longer than a strip brush assembly that only has polymer bristles. The smaller cross-sectional shape of the metal bristles 202 allows each metal bristle 202 to reach into crevices or cracks on the street surface that cannot be reached by polymer bristles 152 that have a wider cross-sectional shape, which is particularly helpful in completely removing weeds or for weed control. The wavy profile of the polymer bristles 152 along with the sinusoidal curve of the metal bristles 202 provide additional cleaning capability with their ability to intertwine to efficiently deflect and move debris encountered during the sweeping motion. For example, two metal bristles 202 that cross each other (such as forming an "X"), can trap debris (such as weeds) at the juncture and pull it away from the street surface S. When the polymer and metal bristles 152 and 202 are intertwined in various areas, the strip brush assembly 10 essentially resembles a net that captures or pushes different size debris that it encounters to provide efficient street cleaning.

The strip brush assembly 10 and its method of making has many advantageous over the prior art, other than those mentioned above, including but not limited to the following:

1. Customization of the strip brush assembly 10 is easily implemented to produce strip brush assembly 10 with different characteristics to meet certain specification and for different purposes or applications. For example, the number of polymer and metal bristles 152 & 202 used in a strip brush assembly 10 can vary, the cross-sectional width and size of the polymer bristles 152 can vary, the gauge of the metal bristles 202 can vary, and the proportional amount of metal bristles 202 to polymer bristles 152 can vary.

2. Single processing line that starts with raw material (i.e. a continuous coil of elongated polymer strips, a continuous coil of elongated metal wire, and raw material for extrusion) and ends with a finished strip brush assembly 10 ready to be used.

3. Continuous processing through a conveyor belt assembly line that can be fully automated and requires minimal manpower to keep the processing going continuously and requires minimal disruption of the process, which saves time and money.

4. No need to stock or use pre-formed base, which is voluminous and more expensive, that the prior art method requires to be fused to the bristles.

5. No need to stock multiple shapes of pre-formed bases to produce different strip brush assemblies. Only need to stock different shaped dies for the extruder 250, which can be easily interchanged.

6. No need to pre-heat a pre-formed base or pressure mold the base as in the prior art to securely anchor the bristles to the base.

7. Overall process is faster and simpler than prior art.

8. Uses only minimal raw material as necessary to produce the strip brush assembly 10 with less waste than the prior art.

9. Uses less heating elements than the prior art; thereby saving energy, costs and the environment.

10. Strip brush assembly 10 of the present invention on a mandrel 500 can withstand a higher revolution per minute speed due to the efficient and effective bonding and anchoring of the polymer and metal bristles 152 & 202 to the formed base 254.

11. Strip brush assembly 10 of the present invention can be used in hot environment as the metal bristles 202 provide support to the polymer bristles 152 that are softened in such environment.

While the strip brush assembly and method of making is mentioned for use with street sweepers, it is not so limited and can be applied to other uses and applications. It is anticipated that the method of the present invention encompasses use of any fusible material or combination of fusible material. For examples, using metal bristles and extruding a formed metal base directly onto the ends of the metal bristles, and using polymer and metal bristles and extruding a formed metal base. It is understood that aside from metal and polymers, ceramics and concrete can also be extruded. Therefore, any current and future material that can be extruded is anticipated to fall within the scope of the present invention.

The features of the invention illustrated and described herein are the preferred embodiments. Therefore, it is understood that the specification is intended to cover unforeseeable embodiments with insubstantial differences that are within the spirit of the specification.

What I claim is:

1. A process of manufacturing a finished strip brush assembly for use with a strip brush having a cylindrical mandrel with a plurality of axial channels having a predetermined shape and size on the outer surface of the mandrel, comprising the steps of:

providing a plurality of pre-determined length polymer bristles that are adjacent to each other having first ends defining a generally planar first continuous layer;

providing a plurality of pre-determined length metal bristles that are adjacent to each other having first ends on top of said polymer bristles defining a generally planar second continuous layer, wherein said first ends of said plurality of metal bristles are in alignment with the first ends of said plurality of polymer bristles;

extruding a formed base that matches the shape and size of the channels directly onto and around said first ends of said plurality of polymer and metal bristles to bond and encapsulate said plurality of polymer and metal bristles in said formed base to be closely adjacent each other in a continuous fashion, with said first continuous layer of polymer bristles stacked above said second continuous layer of metal bristles;

cooling said formed base; and cutting said formed base to a pre-determined length to form a strip brush assembly having uninterrupted, continuous, polymer and metal bristles with said first continuous layer of polymer bristles stacked above said second continuous layer of metal bristles across the entire length of the strip brush assembly for inserting said formed base directly into an axial channel of the cylindrical mandrel.

2. The process of claim 1 further comprising the step of:

providing a length of metal wire;

crimping said length of metal wire to form waves having a generally uniform amplitude;

cutting said length of metal wire to a pre-determined length to form a plurality of metal bristles.

3. The process of claim 1 wherein said polymer bristles form a distinctive polymer bristles section having at least one layer of polymer bristles and said metal bristles form a distinctive metal bristles section having at least one layer of metal bristles abutting said polymer bristles section.

4. The process of claim 1 wherein said first ends of said polymer bristles are pre-heated.

5. The process of claim 1 further comprising the step of polishing said formed base.

* * * * *